United States Patent [19]

Hong

[11] Patent Number: 4,595,306

[45] Date of Patent: Jun. 17, 1986

[54] PENCIL WITH SHARPENER

[76] Inventor: Johnstom Hong, 2 Fl., No. 4, Lane 156, Tatung N. Rd., San Chung, Taiwan

[21] Appl. No.: 675,748

[22] Filed: Nov. 28, 1984

[51] Int. Cl.[4] ..... B43K 29/06; B43K 21/22

[52] U.S. Cl. ..... 401/50; 401/51; 401/67; 401/94

[58] Field of Search ..... 401/50, 51, 94, 67

[56] References Cited

U.S. PATENT DOCUMENTS

| | | | |
|---|---|---|---|
| 419,768 | 1/1890 | Haas | 401/51 |
| 1,296,900 | 3/1919 | Zimdars | 401/51 |
| 1,327,038 | 1/1920 | Hamilton | 401/51 |
| 3,288,113 | 11/1966 | Gabler | 401/50 |

FOREIGN PATENT DOCUMENTS

| | | | |
|---|---|---|---|
| 709835 | 8/1941 | Fed. Rep. of Germany | 401/51 |
| 43255 | 4/1934 | France | 401/51 |
| 122754 | 9/1948 | Sweden | 401/51 |

*Primary Examiner*—Steven A. Bratlie

*Attorney, Agent, or Firm*—Holman & Stern

[57] ABSTRACT

An automatic pencil with a lead-sharpening device, has a pencil lead of a diameter of 2 mm inserted into the pipe sleeve of the pencil case in which a lead-sharpening knife holder is attached. Whenever the lead becomes dull, the user presses and turns the cap on the top of the pencil and then sharpens the lead by the knife holder to make the lead ready for continued use, and the user can retract the lead back to the pencil case if the pencil is not used to prevent the lead from being broken or damaged.

1 Claim, 2 Drawing Figures

PENCIL WITH SHARPENER

SUMMARY OF THE INVENTION

An automatic pencil with a lead-sharpening device, is provided. A head joins the lower end of the pencil case, a compression spring is provided in the pencil case, an outer pipe sleeve is positioned on the upper end of the compression spring, a hollow with a clamp claw joins the lower end of the outer pipe sleeve, a round through hole is provided in the center of the clamp claw, the lower end of this hole is in a conic form in which a knife holder is provided to sharpen the lead, the lower end of the clamp claw splits into several pieces stretching out and opening up at usual times; an inner pipe sleeve is provided in the outer pipe sleeve, the lower end of the inner pipe sleeve is also in a split form, the lead is accommodated in the inner pipe sleeve, the top of the pencil case joins the cap, a round hole is provided in the top face of the cap to accommodate and hold the lead, a plug plugs up the said round hole to avoid the lead from falling out. When the lead becomes dull, the user presses and turns the cap to sharpen the lead properly, when he pushes the cap to the possible extreme extent, the lead is made to protrude out, and after he releases the said pressure imposed against the cap, the lead is secured, when he presses and turns the said cap again, he can retract the lead back into the pencil case, thus preventing the lead falling out and being broken to pieces due to the user's carelessness.

DETAILED DESCRIPTION OF THE INVENTION

Figure 1:
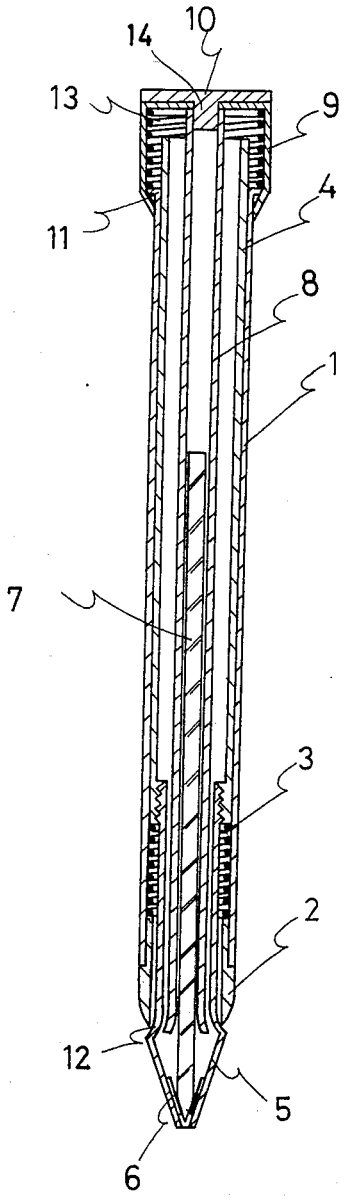
FIG. 1 is a cross sectional view of the structure of the invention

The present invention relates to an automatic pencil with a lead-sharpening device, such that the cap on the top of the pencil can be pressed and turned to sharpen the lead for writing.

Since the current conventional pencils can be approximately classified into 3 major categories, the first category belongs to the wooden pencils, which often need to be sharpened by a razor blade or pencil sharpener during use and thus are easy to hurt the user's fingers and considered inconvenient and unsafe. The second category belongs to the knotted type no sharpening lead refill pencils, for which 10 knotted lead pieces are overlapped and inserted into the pen-case, although they have no need to be sharpened, not even one third of each of such lead pieces can be used before it becomes very dull, and if any one of such lead pieces is lost or missed, the entire pencil can no longer be used, so these pencils are considered wasteful and impractical. The third category belongs to the automatic pencils with a fine lead, this kind of pencil often uses a lead of a daimeter of 0.5 mm, since the lead is too small, it is easy to be broken, so a half of a lead may be not used, and its cap is easy to loosen and fall off, and thus also impractical. Evidently although the conventional pencils are in a wide variety, they have many defects.

The main purpose of the invention is to solve the various defects found on the conventional pencils. Based on the inventor's artful concept and careful study, the prevention uses the design shown in the drawing, for which as a 2 mm lead is inserted into the pencil case, the lead is not easily broken during use, a lead-sharpening knife holder is provided on the front end of the pencil head, thus whenever the lead becomes dull, the user can retract the lead back, presses and turns the cap to sharpen the lead again, so it is safe, convenient and practical.

Figure 2:
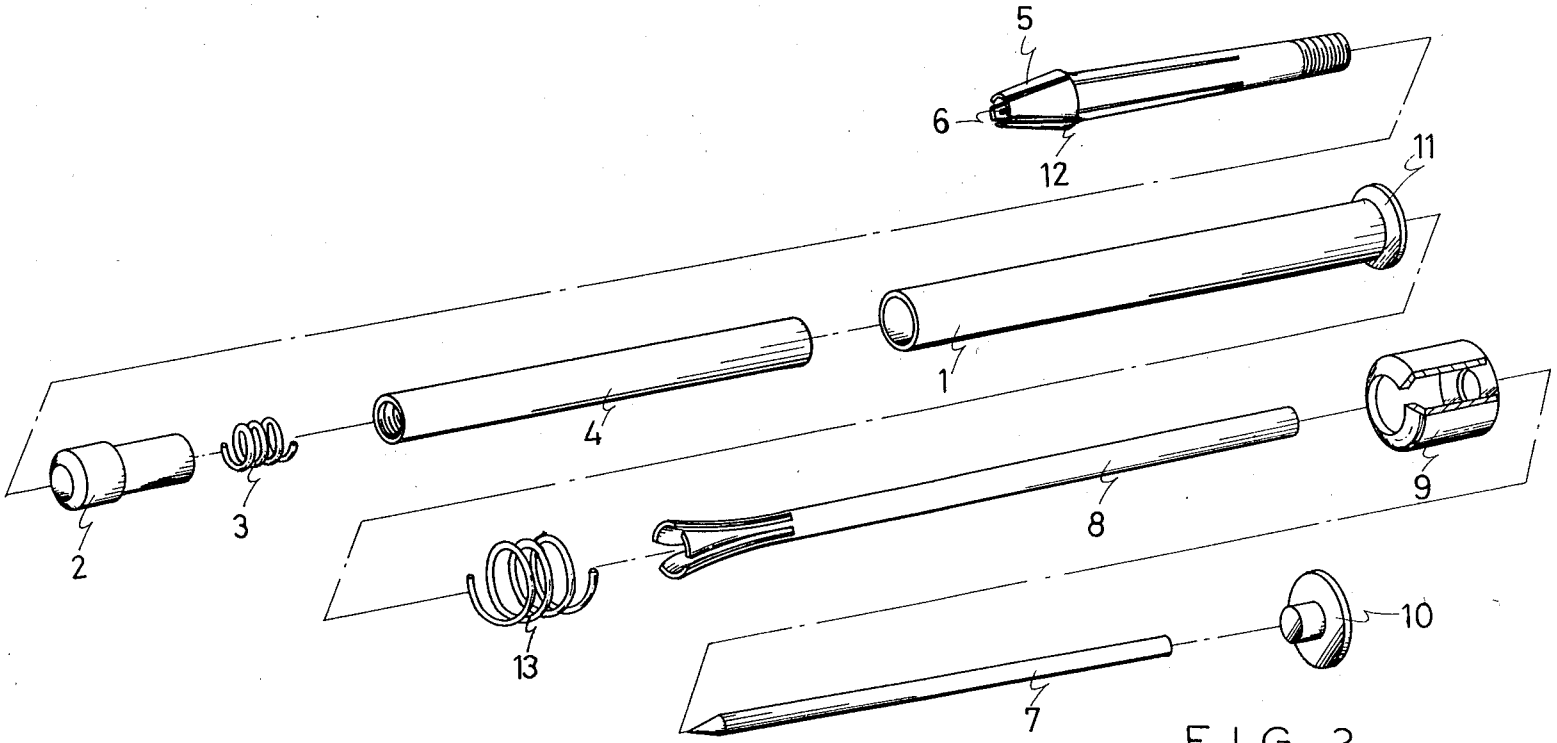
FIG. 2 is an exploded view of the structure of the invention

Other purpose, structure and functions of the invention are detailed in conjunction with the drawings for examplary forms have been shown in FIG. 1 and FIG. 2.

From reference to the above drawings, the invention is constituted by the pencil case (1), head (2), compression spring (3), outer pipe sleeve (4), clamp claw (5), knife holder (6), lead (7), inner pipe sleeve (8), cap (9) and plug (10).

The pencil case (1) is a hollow plastic product, on the end of which a flange (11) is provided, the interior of the head (2) is hollow, the pencil case (1) is sleeved on the top of the head for a tight match, the elastic spring (3) is provided in the interior of the pencil case (1), the lower end of the compression spring (3) presses against the top of the head (2) a screw is provided on the lower end of the pipe sleeve (4), the outer pipe sleeve (4) is sleeved into the pencil case (1), the lower end of the outer pipe sleeve is directly pressed by the compression spring (3), the upper end of the outer pipe sleeve protrudes out of the pencil case (1), a screw is provided close to the lower end of the clamp claw and also split into 4 pieces with elasticity which stretch open outwardly at usual times, but when the claw is sleeved in from the lower end of the head (2) and inserted to the screw of the flange (12) it is retracted, since it is pressed upward by the compression spring (3), the flange (12) pencil case is stuck by the head (2) and cannot retract back to the pencil case (1), a round hole is provided on the clamp claw (5) with its lower diameter often tapered to a conic shape, a lead-sharpening knife holder (6) is provided in the lower end of this hole to sharpen the lead (7).

The lower end of the inner pipe sleeve (8) is also in a split form with elasticity, stretches outwardly at usual times and is inserted into the outer pipe sleeve (4), while its lower end is positioned in the conic shaped hole of the clamp claw (5) and its upper end stretches out of the outer pipe sleeve (4) and is fixedly welded to the top of the cap (9), the cap (9) is sleeved on the top of the pencil case (1), and its lower rim retracts inwardly to catch the flange (11) on the top of the pencil case (1), a compression spring (13) is joined between the flange (11) and the top of the cap (9), a small hole (14) is also provided in the top face of the cap (9), the lead (7) is inserted into the inner pipe sleeve (8) from the top of the cap (9), the plug (10) is joined on the top of the cap (9) to plug the round hole (14) to avoid the lead (7) falling out. When the user wants to sharpen the lead (7), he presses and turns the top of this structure, the cap (9) and the inner pipe sleeve (8) move down together, but now the outer pipe sleeve (4) still does not move, the lower end of the inner pipe sleeve (8) gradually retracts to clamp the lead (7), then the user turns the cap (9) with the lead to be turned together, and can use the knife holder (6) on the lower end of the clamp claw (5) to sharpen the lead (7), when he presses the cap (9) down again, the lower end of the outer pipe sleeve (4) gradually stretches out and opens up, at the same time, the inner pipe sleeve (8) also stretches out and opens up, then the lead (7) can be protruded out, upon relief of the compression, under the action of the compression springs (3) and (13), the cap (9) and the inner and outer pipe sleeve (4) and (8) restore to their original positions, meanwhile, the clamp claw (5) fixes the lead (7) for writing, upon completion of writing, the user presses the cap (9) down to the extreme extent to retract the lead (7) back, thus avoiding the lead being fractured.

I claim:

1. An automatic pencil with a lead-sharpening device the pencil comprising a hollow pencil case having a top flange, a hollow head joined to the lower end of the pencil case, a compression spring on top of the head in the pencil case, an outer pipe sleeve positioned above the compression spring with a top which protrudes from the top of the pencil case, a hollow tube extending into the bottom of the head, the hollow tube having an upper end which is threaded to the lower end of the outer pipe sleeve and a lower end which projects from the head and which is slit to form outer jaw mambers, an inner pipe sleeve accommodated in the outer pipe sleeve, the inner pipe sleeve having an upper end which protrudes from the upper end of the outer pipe sleeve and a lower end split into resilient inner jaw members, a cap coupled to the upper end of the inner pipe sleeve, the cap having a skirt with a lower end which is turned in below the top flange of the pencil case, a further compression spring above the pencil case in the cap, a hole in the cap for insertion of a lead into the inner pipe sleeve, a plug for said hole, and lead sharpener elements fixed internally on the respective outer jaw members for sharpening the lead by depression and rotaton of the cap prior to the lead being projected through the outer jaw members by further depression of the cap accompanied by depression of the outer pipe sleeve and hollow tube.

* * * * *